US006474000B2

(12) United States Patent
Burt

(10) Patent No.: US 6,474,000 B2
(45) Date of Patent: Nov. 5, 2002

(54) SPORTS BOOT HAVING AN INTEGRATED QUICK TIGHTENING SYSTEM

(75) Inventor: Igor Burt, Boulder, CO (US)

(73) Assignee: Salomon S.A., Metz-Tessy (FR)

( * ) Notice: Subject to any disclaimer, the term of this patent is extended or adjusted under 35 U.S.C. 154(b) by 0 days.

(21) Appl. No.: 09/740,970

(22) Filed: Dec. 21, 2000

(65) Prior Publication Data

US 2002/0078597 A1 Jun. 27, 2002

(51) Int. Cl.[7] ..... A43C 11/12
(52) U.S. Cl. ..... 36/50.1; 36/51; 36/54
(58) Field of Search ..... 36/50.1, 51, 54

(56) References Cited

U.S. PATENT DOCUMENTS

| | | | | |
|---|---|---|---|---|
| 1,496,190 | A | | 6/1924 | Watson |
| 1,583,958 | A | | 5/1926 | Cascia |
| 1,862,047 | A | | 6/1932 | Boulet et al. |
| 3,845,575 | A | * | 11/1974 | Boden |
| 4,333,248 | A | * | 6/1982 | Samuels |
| 5,167,084 | A | | 12/1992 | Flammier ..... 36/119 |
| 5,181,331 | A | * | 1/1993 | Berger |
| 5,276,983 | A | * | 1/1994 | Hatfield |
| 5,319,868 | A | * | 6/1994 | Hallenbeck |
| 5,327,662 | A | * | 7/1994 | Hallenbeck |
| 5,477,593 | A | | 12/1995 | Leick ..... 24/12.5 |
| 5,566,474 | A | * | 10/1996 | Leick et al. |
| 5,566,477 | A | * | 10/1996 | Mathis et al. |
| 5,701,688 | A | * | 12/1997 | Crowley |
| 5,966,841 | A | | 10/1999 | Barret |
| 6,128,836 | A | * | 10/2000 | Barret |

FOREIGN PATENT DOCUMENTS

| | | |
|---|---|---|
| DE | 9114617 | 3/1992 |
| DE | 29806942 | 10/1998 |
| DE | 19914980 | 10/2000 |
| EP | 0710451 | 5/1996 |
| FR | 2706743 | 12/1994 |

* cited by examiner

*Primary Examiner*—Ted Kavanaugh
(74) *Attorney, Agent, or Firm*—Greenblum & Bernstein, P.L.C.

(57) ABSTRACT

A sports boot having an outer sole on which an upper is mounted, which has a zone for introducing the foot and a rear upper zone having a medial quarter and a lateral quarter connected to one another by a tightening system constituted by a flexible linkage connecting to one another, along a predetermined alternative path, a series of return elements arranged fixedly on both sides of the quarters, in the vicinity of their edges to define a lacing zone. The return elements associated with the flexible linkage generally constituting the tightening system are arranged on the surfaces of the medial and lateral quarters, directed toward the foot, to constitute a tightening system of the upper, acting from within the latter.

22 Claims, 4 Drawing Sheets

FIG. 2
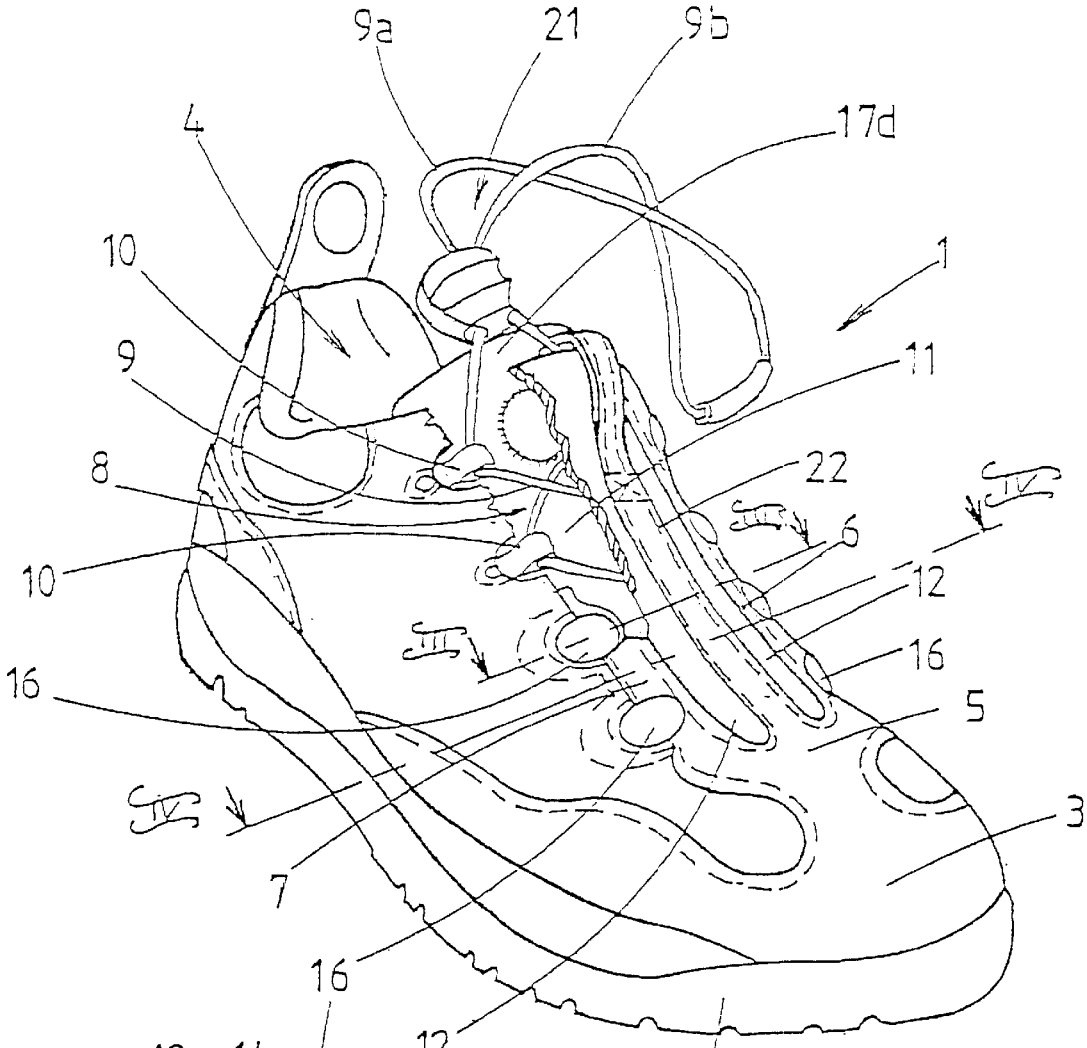
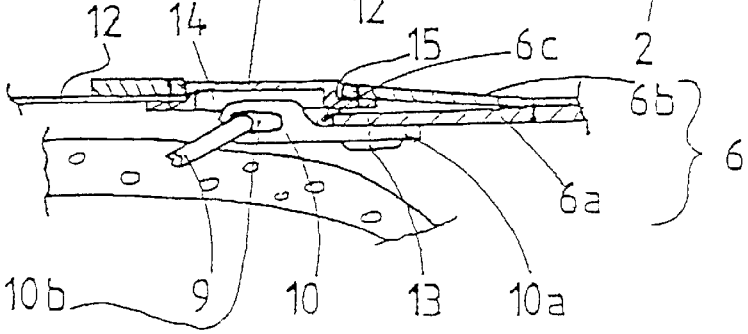
FIG. 3

SPORTS BOOT HAVING AN INTEGRATED QUICK TIGHTENING SYSTEM

BACKGROUND OF THE INVENTION

1. Field of the Invention

The present invention relates to a sports boot having an outer sole on which an upper is mounted, which includes a zone for introducing the foot and a rear upper zone including a medial quarter and a lateral quarter connected to one another by a tightening system.

2. Description of Background and Relevant Information

The known tightening systems are constituted by a flexible linkage connecting to one another, along a predetermined alternative path, a series of return elements arranged fixedly on both sides of the quarters, in the vicinity of their edges to define a lacing zone.

The known tightening systems of this type are generally arranged outside the boot, which has the disadvantage of not offering a perfect imperviousness against external elements, especially snow, ice, water, stones, etc., despite the presence of an inner tongue for covering the foot. In addition, the return elements arranged so as to project on the outer surfaces of the quarters constitute as many projections on the top of the boot, detrimentally promoting the risks of hooking during the practice of the sport, especially more or less "aggressive" sports such as biking, hiking, etc.

To overcome these disadvantages, it is known to obtain an increased imperviousness of the lacing zone against external aggressions or elements, while protecting the user from the return elements, by providing the lacing zone on an internal tightening device and arranging above the lacing zone a flap that can be opened or closed as required by means of a zipper. Such a construction is known from U.S. Pat. No. 5,167,084, for example.

While this remedies the aforementioned problems efficiently, it however increases the cost of the boot considerably. Furthermore, zippers pose problems of ill-timed opening.

SUMMARY OF THE INVENTION

The present invention makes it possible to overcome all of the aforementioned disadvantages and, to this end, the invention relates to a sports boot having an outer sole on which an upper is mounted, which includes a zone for introducing the foot and a front upper zone including a medial quarter and a lateral quarter connected to one another by a tightening system constituted by a flexible linkage connecting to one another, along a predetermined alternative path, a series of return elements arranged fixedly on both sides of the quarters, in the vicinity of their edges to define a lacing zone, wherein the return elements associated with the flexible linkage generally constituting the tightening system are arranged on the surfaces of the medial and lateral quarters of the upper, directed toward the foot, to constitute a system for tightening the upper, acting from within the latter.

In this way, not only is imperviousness perfectly obtained, but the return elements are not apparent, which provides the boot with a quite unusual and very aesthetic aspect, at an acceptable cost.

The present invention also relates to the characteristics which will become apparent from the description that follows, and which must be considered separately or according to all of their possible technical combinations.

BRIEF DESCRIPTION OF DRAWINGS

This description, provided by way of a non-limiting example, will help to better understand how the invention can be embodied, with reference to the annexed drawings, in which:

FIG. 2 shows a perspective view according to FIG. 1, a portion of the upper being shown partially broken-away;

FIG. 3 shows a cross-sectional view along the line III—III of FIG. 2;

DETAILED DESCRIPTION OF THE INVENTION

Figure 1:
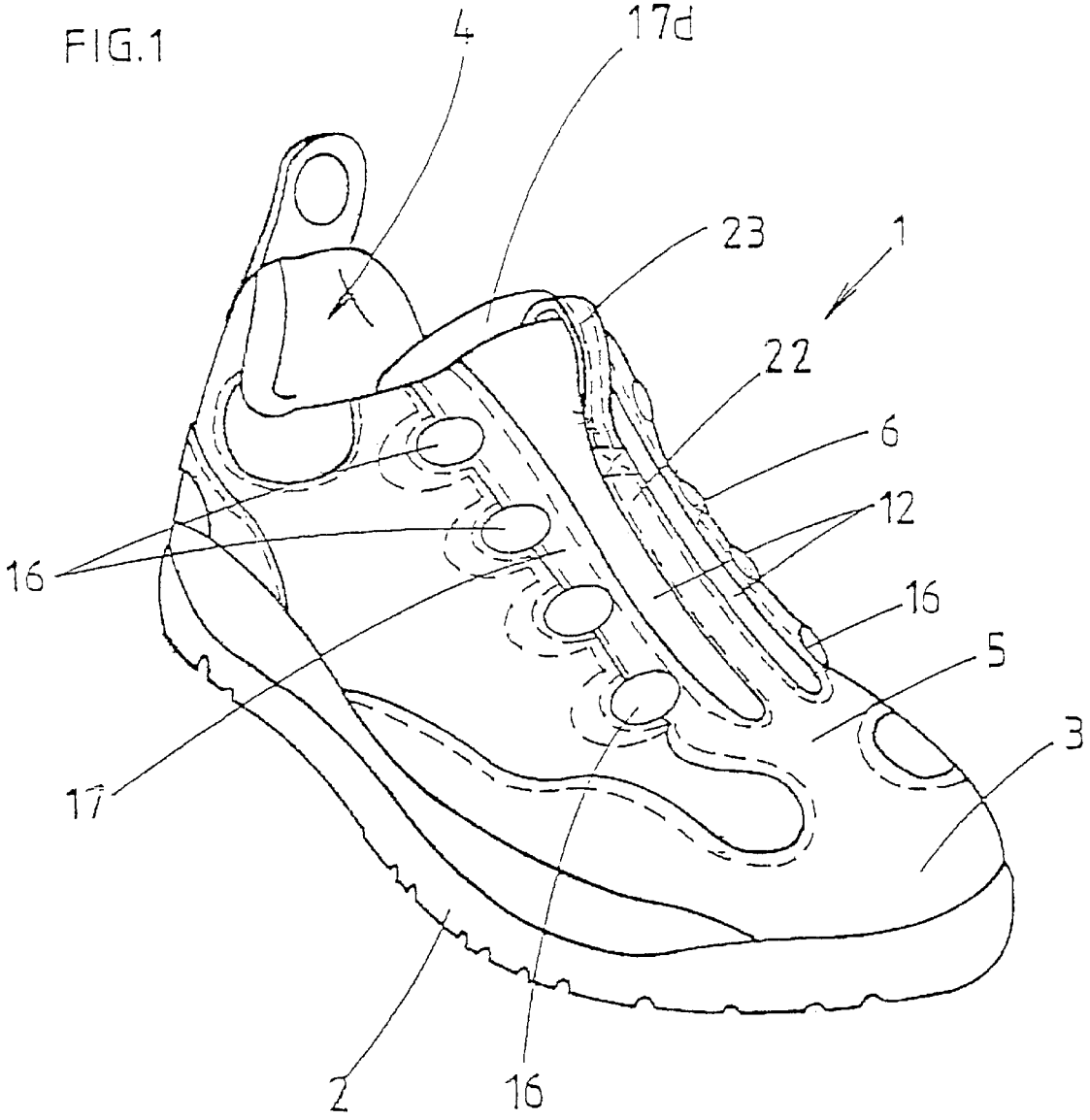
FIG. 1 shows a perspective view of a sports boot according to the invention.

The sports boot 1 according to the invention has an outer sole 2 on which an upper 3 is mounted, which includes a zone 4 for introducing the foot and an upper front zone 5 including a medial quarter 6, i.e., located on the medial side of the boot, and a lateral quarter 7, i.e., located on the lateral side of the boot, connected to one another by a tightening system 8 constituted by a flexible linkage 9 connecting to one another, along a predetermined alternative path, a series of return elements 10 arranged fixedly on both sides of the quarters 6 and 7, in the vicinity of their longitudinally extending edges 6*b*, 7*b*, respectively, to define a lacing zone 11.

Figure 4:
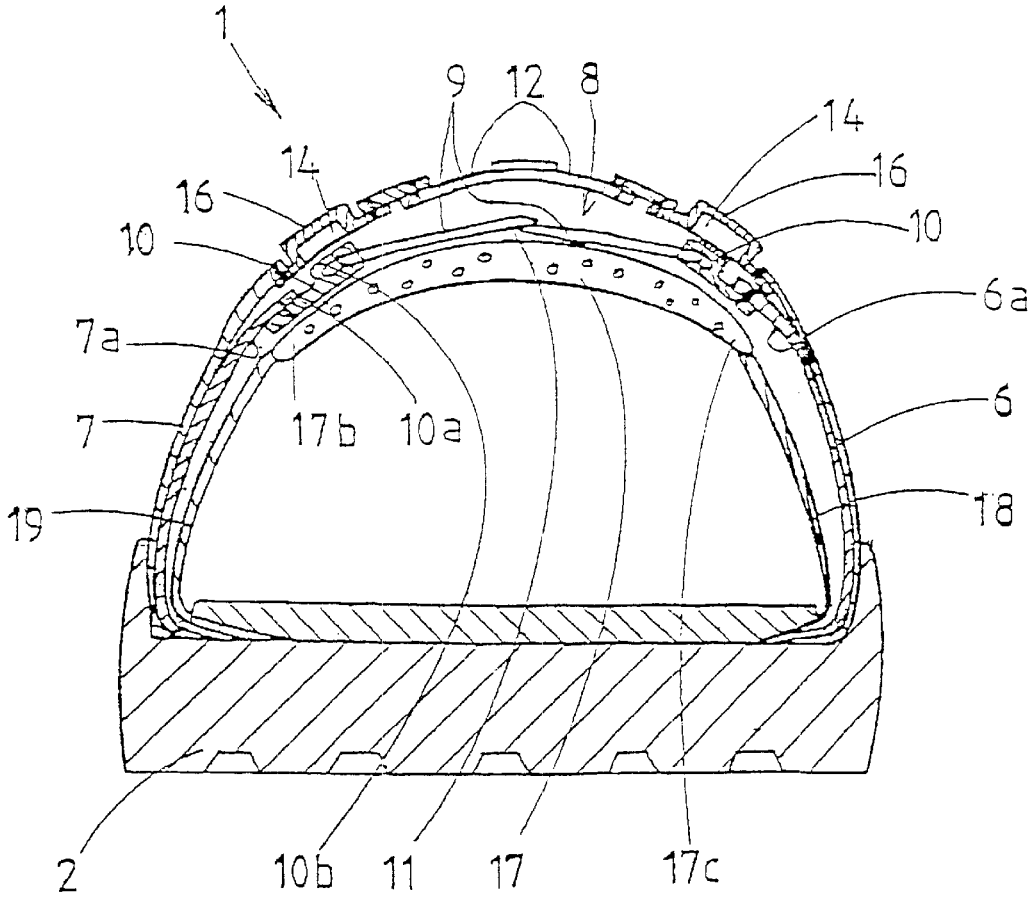
FIG. 4 shows a cross-sectional view along the line IV—IV of FIG. 3.
Figure 5:
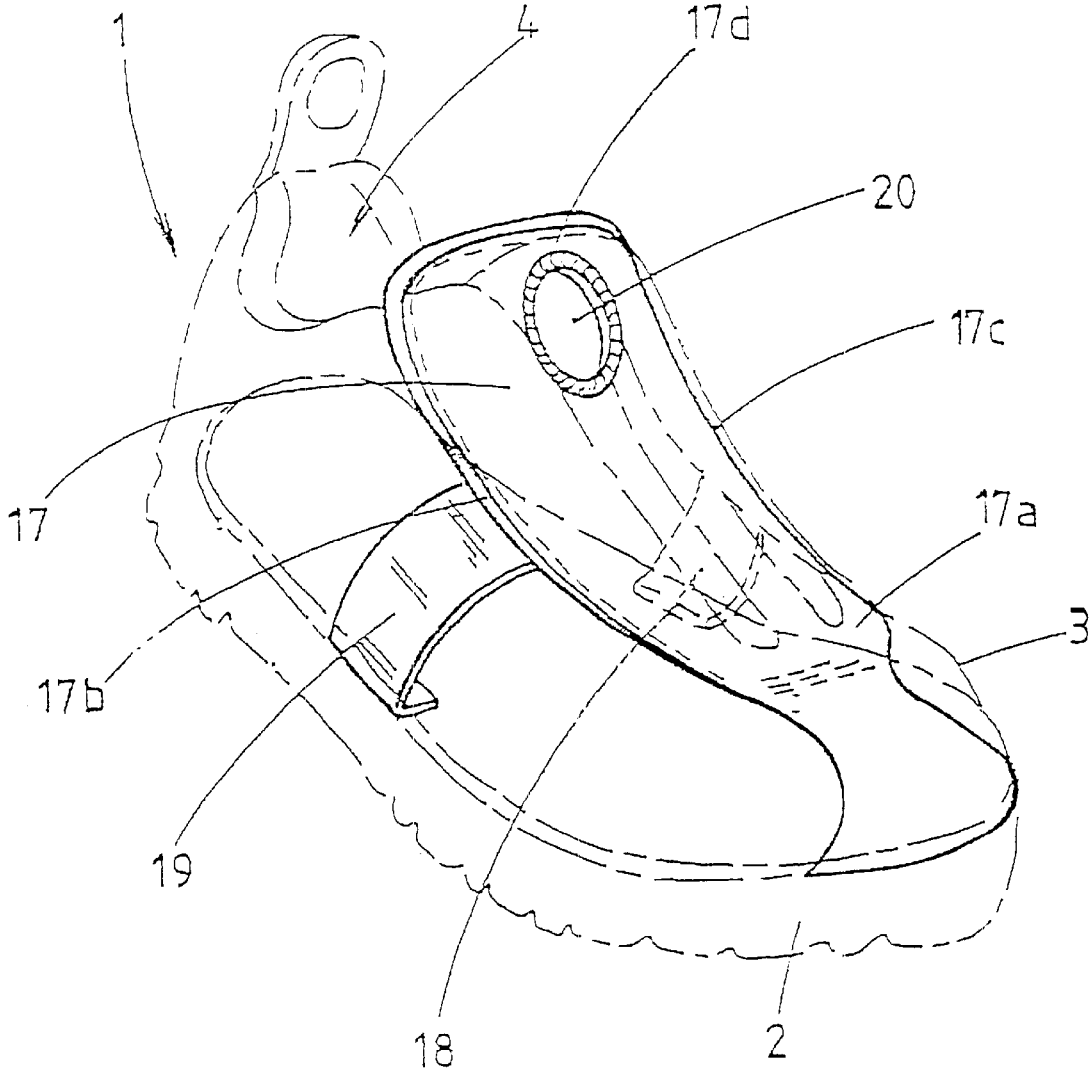
FIG. 5 shows a view of an internal protective tongue of the boot according to FIGS. 1–4.

According to the invention, and as shown particularly well in FIGS. 2, 3, and 4, the return elements 10 associated with the linkage 9, generally constituting the tightening system 8, are arranged on the inner surfaces 6*a*, 7*a* of the medial 6 and lateral 7 quarters, i.e., directed toward the foot to constitute a system for tightening the upper 3, acting from within the latter.

Advantageously, the medial 6 and lateral 7 quarters are connected to one another by a band of elastic material 12 joining the edges 6*c*, 7*c* of each of them to constitute a closed upper that is extensible during the passage of the foot, in order to facilitate its introduction on the foot, and then to tighten the latter by traction on the quarters 6 and 7 by means of the linkage 9 and of the internal return elements 10.

Furthermore, the band of elastic material makes it possible to conserve a clearly defined and "stretched" aspect of the front upper zone 5 of the upper 3, regardless of the volume, small or large, of the foot enclosed in the boot.

According to another characteristic of the invention, the return elements 10 include a base 10*a*and a sliding portion 10*b*, also called the free end, adapted to receive the tightening linkage 9 and to enable the sliding thereof. These return elements 10 are fixed by their base 10*a*on the inner surfaces 6*a*, 7*a* of the quarters 6 and 7, especially by a crimping 13. They are extended by their free end portion 10*b*adapted to cooperate with the linkage 9 by going around or extending through, while being positioning in front of a corresponding housing 14 provided in the quarters 6 and 7, so as to avoid the excessive thicknesses.

This offers an appreciable additional comfort. The return elements 10 can have a sliding portion 10*b* that is either open or closed.

As shown particularly well in FIG. 3, each of the housings 14 in which the free end portions 10*b* of the return elements 10 are positioned is blind.

According to the present embodiment, each of the blind housings 14 of the return elements 10 is obtained by a circular cutting 15 made on both sides of the edges 6*c*, 7*c* of the quarters 6 and 7 of the upper 3, then by sealing the cutting 15 by means of an internally recessed cap 16, which is peripherally affixed to the quarters 6 and 7 of the upper 3. Thereby, as seen in FIG. 3, a lower end of the housing 14 is open for at least partially receiving a return element 10 and an upper end of the housing 14 is closed.

This can be obtained by gluing or by sewing a peripheral edge of the cap 16 on the corresponding portion of the quarters 6 and 7 of the upper 3.

Preferably, especially to facilitate the assembly, the caps 16 are connected to one another by a bar, as shown in broken lines in FIGS. 1 and 2. To improve the aesthetic aspect, they are preferably made of a plastic material that is transparent or opaque, so as to enable the visualization of the return elements 10.

According to another characteristic of the invention, the boot 1 further includes a comfort tongue 17 extending beneath the lacing zone 11, which is affixed by its base 17*a* to a zone of the upper 3 located at the front of the lacing zone 11, on the one hand, and affixed by its lateral sides 17*b*, 17*c* to corresponding lateral zones of the upper 3 located in the area of the sole 2, on the other hand, by means of elastic straps 18 and 19, so as to ensure the return of the comfort tongue 17 to the initial position, after having exerted a traction on its free end 17*d*, in view of loosening the lacing when taking off the boot.

The comfort tongue 17 is itself made of a padded material and has in its free end zone 17*a* a manual gripping element 20 that makes it possible to exert a traction on the tongue 17.

More specifically, the manual gripping element 20 is constituted by a hole forming a ring whose size and shape enable a finger to be introduced.

As shown particularly well in FIG. 2, the flexible linkage 9 cooperates with the return elements 10 along a closed path, i.e., the flexible linkage defines a closed loop, and is associated with a quick tightening system 21 acting on the external portions of the linkage 9 located outside the lacing zone 11.

Preferably, the quick tightening system 21 is constituted by a blocker sliding on two strands 9*a*, 9*b* of the flexible linkage 9.

Such a blocker is, for example, described in the commonly owned FR 2 706 743.

The quick tightening system 21 could also be constituted by a system affixed to the boot and actuated by a tensioning lever connected to the strands of the flexible linkage 9.

In addition, the upper 3 has, from its front end zone 5, and extending up to the area of the introduction zone 4, an extension 22 affixed by sewing to the band of elastic material 12 joining the edges of each of the medial quarters 6 and 7.

This extension 22 also has at its end directed toward the top of the foot a pulling loop 23 obtained by folding it back, so as to facilitate putting on the boot by traction on the end 23 of the extension 22 of the upper 3, in order to more widely open the zone 4 for introducing the foot by traction on the band of elastic material 12.

In the embodiment shown and described, the upper quarters 6, 7 in fact have on the inner side a lining 6*a*, 6*b*, respectively, on which the return elements 10 are fixed, and on the outer side, an external surface 6*b* on which the housings 14 for the return elements 10 are fixed. Such a construction makes it possible to avoid as much as possible any excessive thickness that could negatively affect the comfort of the foot. The quarters 6, 7 can be single layered.

The present invention is not limited to the embodiment described hereinabove, but encompasses all similar or equivalent embodiments. Thus, the elastic material 12, as well as the remainder of the upper, can be made of an impervious material for a perfect sealing of the boot.

What is claimed is:

1. A sports boot comprising:

an outer sole, an external upper mounted on said outer sole, said upper comprising a zone for introducing the foot and a front upper zone comprising a medial quarter and a lateral quarter, said medial and lateral quarters having respective inner surfaces, a tightening system connecting together said medial and lateral quarters, said tightening system comprising a flexible linkage connecting to one another, along a predetermined alternating path, a series of return elements arranged fixedly on both of said medial and lateral quarters, in the vicinity of edges of said medial and lateral quarters to define a lacing zone, said return elements being associated with the flexible linkage generally constituting the tightening system being arranged on the inner surfaces of the medial and lateral quarters to constitute a system for tightening the upper, acting from within the upper, said flexible linkage being maintained beneath, and not extending through, said medial and lateral quarters in said lacing zone, wherein the medial and lateral quarters are connected to one another by a band of elastic material joining said edges of each of them to constitute a closed upper that is extensible during the passage of the foot.

2. A boot according to claim 1, wherein the return elements are fixed by their base to the inside of the inner surfaces of the quarters, and are extended by a free end portion adapted to cooperate with the linkage by going around or extending through, while positioning itself in front of a corresponding housing provided in said quarters, so as to avoid the excessive thicknesses.

3. A boot according to claim 2, wherein each of the housings in which the free end portions of the return elements are positioned is open at a lower end and closed at an upper end.

4. A boot according to claim 3, wherein each of the blind housings of the return elements is obtained by a circular cutting made on both sides of the edges of the quarters of the upper, then by sealing said cutting by means of an internally recessed cap affixed to the quarters of the upper.

5. A boot according to claim 1, further comprising a comfort tongue extending beneath the lacing zone, which is affixed by its base to a zone of the upper located at the front of said lacing zone, and affixed by its lateral sides to corresponding lateral zones of the upper located in the area of the sole by means of elastic straps.

6. A boot according to claim 5, wherein the protective tongue comprises in its free end zone a manual gripping element that makes it possible to exert a traction on said tongue.

7. A boot according to claim 6, wherein the manual gripping element is constituted by a hole forming a ring whose size and shape enable the introduction of a finger.

8. A boot according to claim 1, wherein the flexible linkage cooperates with the return elements along an endless path and is associated with a quick tightening system acting on the external portions of the linkage located outside the lacing zone.

9. A boot according to claim 8, wherein the quick tightening system is constituted by a blocker sliding on two strands of the flexible linkage.

10. A boot according to claim 1, wherein the upper comprises, from its front end zone, an extension affixed to the band of elastic material, and extending up to an area of the introduction zone.

11. A boot according to claim 1, wherein:

no return elements are affixed to an outer surface of said external upper.

12. A sports boot comprising:

an outer sole, an external upper mounted on said outer sole, said upper comprising a zone for introducing the foot and a front upper zone comprising a medial quarter and a lateral quarter, said medial and lateral quarters having respective inner surfaces, a tightening system connecting together said medial and lateral quarters, said tightening system comprising a flexible linkage connecting to one another, along a predetermined alternating path, a series of return elements arranged fixedly on both of said medial and lateral quarters, in the vicinity of edges of said medial and lateral quarters to define a lacing zone, thereby directly connecting together said medial and lateral quarters, said return elements being associated with the flexible linkage generally constituting the tightening system being arranged on the inner surfaces of the medial and lateral quarters to constitute a system for tightening the upper, acting from within the upper, said flexible linkage being maintained beneath said medial and lateral quarters in said lacing zone, respective longitudinally extending edges of said medial and lateral quarters being connected to one another by a piece of material to constitute a closed upper, said closed upper being at least partially elastic to provide extensibility of the upper during introduction of the foot into the boot.

13. A boot according to claim 12, wherein said piece of material connecting said longitudinally extending edges of said medial and lateral quarters of said upper is elastic.

14. A boot according to claim 12, wherein:

no return elements are affixed to an outer surface of said external upper.

15. A sports boot comprising:

an outer sole;

an external upper mounted on said outer sole, said upper comprising a foot-introduction zone and an upper front zone, said upper front zone comprising a medial quarter and a lateral quarter, said upper front zone further comprises a longitudinally extending band of material connecting said medial quarter to said lateral quarter;

a tightening system connecting together said medial and lateral quarters for tightening the boot upon a wearer's foot, said tightening system comprising:

a first series of return elements fixed to a longitudinally extending edge of said medial quarter of said upper and a second series of return elements fixed to a longitudinally extending edge of said lateral quarter of said upper, said first and second series of return elements defining a lacing zone, said first and second series of return elements and said flexible linkage positioned entirely beneath said band of material and beneath said medial and lateral quarters along said lacing zone; and a flexible linkage extending along said lacing zone by alternately connecting said return elements of said medial and lateral quarters;

said upper front zone being closed along said lacing zone, whereby said upper front zone extends over said flexible linkage and over said series of return elements along said lacing zone, said upper front zone of said upper being flexible to facilitate introduction of a wearer's foot into said foot-introduction zone of said upper.

16. A sports boot according to claim 15, wherein:

said band of material is an elastic material, whereby said closed upper front zone of said upper is made extensible as the wearer's foot is introduced into said foot-introduction zone of said upper.

17. A sports boot according to claim 16, wherein:

said upper front zone of said upper further comprises a longitudinal extension affixed to said band of elastic material, and extending from forward of said lacing zone to said foot-introduction zone of said upper.

18. A sports boot according to claim 15, further comprising:

a tongue longitudinally extending beneath said lacing zone, said tongue being affixed to said upper forward of said lacing zone.

19. A sports boot according to claim 15, wherein:

said flexible linkage extends along an endless path, said tightening system further comprising a quick-tightening mechanism acting on portions of said flexible linkage located outside of said lacing zone.

20. A sports boot according to claim 19, wherein:

said quick-tightening mechanism includes a blocker sliding on two strands of said flexible linkage.

21. A sports boot comprising:

an outer sole;

an upper mounted on said outer sole, said upper comprising a foot-introduction zone and an upper front zone, said upper front zone comprising a medial quarter and a lateral quarter;

a tightening system connecting together said medial and lateral quarters for tightening the boot upon a wearer's foot, said tightening system comprising:

a first series of return elements fixed to a longitudinally extending edge of said medial quarter of said upper and a second series of return elements fixed to a longitudinally extending edge of said lateral quarter of said upper, said first and second series of return elements defining a lacing zone; and a flexible linkage extending along said lacing zone by alternately connecting said return elements of said medial and lateral quarters;

said upper front zone being closed along said lacing zone, whereby said upper front zone extends over said flexible linkage and over said series of return elements along said lacing zone, said upper front zone of said upper being flexible to facilitate introduction of a wearer's foot into said foot-introduction zone of said upper;

said first series of return elements being fixed to an inner surface of said medial quarter of said upper and said second series of return elements being fixed to an inner surface of said lateral quarter of said upper;

said upper front zone of said upper further comprising a first series of housings for housing respective ones of said return elements of said first series of return elements and a second series of housings for housing respective ones of said return elements of said second series of return elements, each of said housings having a closed upper end covering a respective one of said return elements.

22. A sports boot according to claim 21, wherein:

said upper is an external upper.

* * * * *